US009409198B2

(12) United States Patent
Hosokawa et al.

(10) Patent No.: US 9,409,198 B2
(45) Date of Patent: Aug. 9, 2016

(54) METHOD AND APPARATUS FOR APPLYING COATING SOLUTION, AND METHOD FOR MANUFACTURING COATED PRODUCT

(75) Inventors: Toshitsugu Hosokawa, Ibaraki (JP); Keiichi Okamoto, Ibaraki (JP); Satoru Yamamoto, Ibaraki (JP)

(73) Assignee: NITTO DENKO CORPORATION, Ibaraki-shi (JP)

( * ) Notice: Subject to any disclaimer, the term of this patent is extended or adjusted under 35 U.S.C. 154(b) by 347 days.

(21) Appl. No.: 13/989,189

(22) PCT Filed: Nov. 24, 2011

(86) PCT No.: PCT/JP2011/077029

§ 371 (c)(1),
(2), (4) Date: May 23, 2013

(87) PCT Pub. No.: WO2012/073781

PCT Pub. Date: Jun. 7, 2012

(65) Prior Publication Data

US 2013/0243957 A1 Sep. 19, 2013

(30) Foreign Application Priority Data

Dec. 2, 2010 (JP) ..... 2010-269437

(51) Int. Cl.

| | |
|---|---|
| ***B05C 5/02*** | (2006.01) |
| ***B05D 1/26*** | (2006.01) |
| ***B05C 3/18*** | (2006.01) |

(52) U.S. Cl.

CPC ..... *B05C 3/18* (2013.01); *B05C 5/0254* (2013.01); *B05D 1/26* (2013.01); *B05D 2252/02* (2013.01)

(58) Field of Classification Search

None

See application file for complete search history.

(56) References Cited

U.S. PATENT DOCUMENTS

| | | | | |
|---|---|---|---|---|
| 5,674,556 | A * | 10/1997 | Fukumura | B05C 5/0254 427/113 |
| 6,033,723 | A | 3/2000 | Kistler et al. | |
| 2003/0140849 | A1 | 7/2003 | Kawabe | |
| 2007/0231479 | A1 | 10/2007 | Ogawa et al. | |
| 2008/0213471 | A1 * | 9/2008 | Oki et al. | 427/162 |
| 2008/0261047 | A1 | 10/2008 | Shibata | |

(Continued)

FOREIGN PATENT DOCUMENTS

| | | | |
|---|---|---|---|
| CN | 101274315 | A | 10/2008 |
| CN | 101279315 | A * | 10/2008 |

(Continued)

OTHER PUBLICATIONS

Japanese Office Action dated Jul. 10, 2014, issued in corresponding Japanese Patent Application No. 2010-269437, w/English translation (4 pages).

(Continued)

*Primary Examiner* — Lisha Jiang

(74) *Attorney, Agent, or Firm* — Westerman, Hattori, Daniels & Adrian, LLP

(57) ABSTRACT

The invention is a method, an apparatus, and a coated product-manufacturing method each capable of applying a coating solution to a flexible backing sheet using a die coater while preventing contaminants from forming defects. A virtual line L is drawn to pass through the discharge port 74 of the die coater 7 and to extend perpendicular to the backing sheet 1, the distance D1 between a starting line P1 and a boundary line P2 is 50 mm or less, and the distance between the starting line P1 and a line on the roller P3 is 5 μm or more.

3 Claims, 4 Drawing Sheets

(56) References Cited

U.S. PATENT DOCUMENTS

| | | | |
|---|---|---|---|
| 2011/0097476 | A1 | 4/2011 | Ishizu et al. |
| 2011/0165317 | A1 | 7/2011 | Shibata |

FOREIGN PATENT DOCUMENTS

| | | | |
|---|---|---|---|
| CN | 101811111 | A | 8/2010 |
| CN | 101883639 | A | 11/2010 |
| JP | 6-126229 | A | 5/1994 |
| JP | 11-314062 | A | 11/1999 |
| JP | 2000-005167 | | 1/2000 |
| JP | 2000-5685 | A | 1/2000 |
| JP | 2000-51767 | A | 2/2000 |
| JP | 2000-61388 | A | 2/2000 |
| JP | 2003-10762 | A | 1/2003 |
| JP | 2003-251260 | A | 9/2003 |
| JP | 2005-137983 | A | 6/2005 |
| JP | 2006-112003 | A | 4/2006 |
| JP | 2007-268385 | A | 10/2007 |
| JP | 2007-330873 | A | 12/2007 |
| JP | 4163876 | B2 | 10/2008 |
| TW | 200920499 | A | 5/2009 |

OTHER PUBLICATIONS

International Search Report of PCT/JP2011/077029, mailing date of Feb. 28, 2012.

Chinese Search Report dated May 13, 2014, issued in corresponding Chinese application No. 2011800573864 (6 pages), with English translation.

Japanese Office Action dated Apr. 30, 2014, issued in corresponding Japanese Application No. 2010-269437, with English Translation (4 pages).

Translation of the International Preliminary Report on Patentability (PCT/IB/338) (1 page), (PCT/IB/373) (1 page) of International Application No. PCT/JP2011/077029 mailed Jun. 13, 2013 (Form PCT/ISA/237) (4 pages).

Search Report dated May 30, 2016, issued in counterpart Taiwanese Patent Application No. 100144150, with English translation. (2 pages).

Notice of Allowance dated May 26, 2016, issued in counterpart Taiwanese Patent Application No. 100144150. (2 pages).

* cited by examiner (a)

(b)

(c)

METHOD AND APPARATUS FOR APPLYING COATING SOLUTION, AND METHOD FOR MANUFACTURING COATED PRODUCT

TECHNICAL FIELD

The invention relates to a method and an apparatus for applying a coating solution to a flexible backing sheet using a die coater, and also to a method for manufacturing a coated product.

BACKGROUND ART

There is a known technique for applying a coating solution to the surface of a backing sheet (web), such as a flexible film, using a die coater. Patent Documents 1 and 2 disclose an example of such a technique, which includes applying a coating solution to a backing sheet using a slot die coater while feeding the backing sheet as a backup roller rotates, wherein the slot die coater is located across the backing sheet from the backup roller.

The backing sheet has first and second surfaces, in which the first surface is to be coated with the coating solution, and the second surface is opposite to the first surface. The backup roller rotates with its outer surface in contact with the second surface of the backing sheet. The slot die coater for discharging the coating solution is placed at a position facing the contact part of the backing sheet in contact with the backup roller. The coating solution is discharged from the slot die coater to the backing sheet being fed by the rotation of the backup roller, so that the first surface of the backing sheet is coated with the coating solution.

PRIOR ART DOCUMENTS

PATENT DOCUMENTS

Patent Document 1: JP-A-2003-251260
Patent Document 2: JP 4163876

SUMMARY OF THE INVENTION

Problems to be Solved by the Invention

In the above conventional technique, however, if a contaminant is caught between the outer surface of the backup roller and the backing sheet, the coating solution may be applied thinner at a part of the backing sheet opposed to the contaminant. In this case, a problem occurs in which the surface of the coating solution is not leveled during drying, so that a dented point defect can occur.

FIG. 5 is a schematic view for illustrating a case where a contaminant is caught between the outer surface of a backup roller and a backing sheet 1 in the application of a coating solution. As shown in part (a) of FIG. 5, when a contaminant is caught between the outer surface of a backup roller and a backing sheet 1, the backing sheet 1 is pushed at a point in contact with the contaminant, so that a bump 101 is formed on the backing sheet 1. If a coating solution is applied to a first surface of the backing sheet 1 in this state from a slot die coater placed at a specific position and if the backing sheet 1 then returns to its original shape, as shown in part (b) of FIG. 5, a dent 102 will be formed on the surface of the coating solution at a position corresponding to the bump 101. As shown in part (c) of FIG. 5, the surface of the coating solution having such a dent 102 can have a dented point defect 103 left even after drying.

The invention has been accomplished under the circumstances described above. It is an object of the invention to provide a method, an apparatus, and a coated product-manufacturing method each capable of applying a coating solution to a flexible backing sheet using a die coater while preventing contaminants from forming defects. It is another object of the invention to provide a method, an apparatus, and a coated product-manufacturing method each capable of applying a coating solution to a flexible backing sheet using a die coater while preventing the occurrence of streaks.

Means for Solving the Problems

The invention is directed to a method for applying a coating solution to a first surface of a flexible backing sheet from a discharge port of a die coater, wherein the backing sheet is being fed, and the discharge port linearly extends along a transverse direction perpendicular to the direction of feed of the backing sheet. The method includes bringing a second surface of the backing sheet into contact with the outer surface of a roller while feeding the backing sheet as the roller rotates, wherein the second surface is opposite to the first surface to which the coating solution is applied, and applying the coating solution to the first surface of the backing sheet from the discharge port of the die coater while feeding the backing sheet as the roller rotates, wherein the discharge port is located downstream relative to the roller, wherein when a virtual line is drawn to pass through the discharge port of the die coater and to extend perpendicular to the backing sheet, the distance between a starting line and a boundary line is 50 mm or less, wherein the starting line is defined as a line intersecting with the virtual line on the second surface of the backing sheet, and the boundary line is defined as a line at a boundary where the second surface of the backing sheet begins to separate, upstream of the starting line, from the outer surface of the roller as the roller rotates, and the distance between the starting line and a line on the roller is 5 μm or more, wherein the line on the roller is defined as a line intersecting with the virtual line on the outer surface of the roller.

According to the invention, when a virtual line is drawn to pass through the discharge port of the die coater and to extend perpendicular to the backing sheet, the distance between a line on the roller and a starting line is 5 μm or more, wherein the line on the roller is a line intersecting with the virtual line on the outer surface of the roller, and the starting line is a line intersecting with the virtual line on the second surface of the backing sheet. This feature makes it possible to prevent a contaminant from pushing the part of the backing sheet where the coating solution is being applied even when the contaminant is caught between the outer surface of the roller and the backing sheet. Thus, this feature effectively prevents dented point defects, which would otherwise occur if the coating solution is applied thinner at some points.

In addition, the distance between the starting line and the boundary line is 50 mm or less, wherein the boundary line is a line at a boundary where the second surface of the backing sheet begins to separate, upstream of the starting line, from the outer surface of the roller as the roller rotates. Thus, the backing sheet being fed is kept relatively flat as well as it is kept flat at the position of the boundary line. The discharge port of the die coater is placed at a position facing the starting line on the backing sheet kept in such a relatively flat state, and the coating solution is applied to the first surface of the backing sheet from the discharge port placed at such a position. Thus, the surface of the coating solution on the backing sheet can be made smooth even without significantly pressing the backing sheet with the die coater. This can effectively prevent press-induced streaks.

The invention is directed to another method for applying a coating solution to a first surface of a flexible backing sheet from a discharge port of a die coater, wherein the backing sheet is being fed, and the discharge port linearly extends along a transverse direction perpendicular to the direction of feed of the backing sheet. The method includes bringing a second surface of the backing sheet into contact with the outer surface of a roller while feeding the backing sheet as the roller rotates, wherein the second surface is opposite to the first surface to which the coating solution is applied, and applying the coating solution to the first surface of the backing sheet from the discharge port of the die coater while feeding the backing sheet as the roller rotates, wherein the discharge port is located upstream relative to the roller, wherein when a virtual line is drawn to pass through the discharge port of the die coater and to extend perpendicular to the backing sheet, the distance between a starting line and a boundary line is 50 mm or less, wherein the starting line is defined as a line intersecting with the virtual line on the second surface of the backing sheet, and the boundary line is defined as a line at a boundary where the second surface of the backing sheet begins to contact, downstream of the starting line, the outer surface of the roller, and the distance between the starting line and a line on the roller is 5 μm or more, wherein the line on the roller is defined as a line intersecting with the virtual line on the outer surface of the roller.

According to the invention, when a virtual line is drawn to pass through the discharge port of the die coater and to extend perpendicular to the backing sheet, the distance between a line on the roller and a starting line is 5 μm or more, wherein the line on the roller is a line intersecting with the virtual line on the outer surface of the roller, and the starting line is a line intersecting with the virtual line on the second surface of the backing sheet. This feature makes it possible to prevent a contaminant from pushing the part of the backing sheet where the coating solution is being applied even when the contaminant is caught between the outer surface of the roller and the backing sheet. Thus, this feature effectively prevents dented point defects, which would otherwise occur if the coating solution is applied thinner at some points.

In addition, the distance between the starting line and the boundary line is 50 mm or less, wherein the boundary line is a line at a boundary where the second surface of the backing sheet begins to contact, downstream of the starting line, the outer surface of the roller. Thus, the backing sheet being fed is kept relatively flat as well as it is kept flat at the position of the boundary line. The discharge port of the die coater is placed at a position facing the starting line on the backing sheet kept in such a relatively flat state, and the coating solution is applied to the first surface of the backing sheet from the discharge port placed at such a position. Thus, the surface of the coating solution on the backing sheet can be made smooth even without significantly pressing the backing sheet with the die coater. This can effectively prevent press-induced streaks.

The coating solution is preferably applied to the backing sheet to form a wet coating with a thickness of 10 μm to 150 μm.

According to the invention, when the coating solution is applied to form such a relatively thick wet coating of 10 to 150 μm thickness, the occurrence of defects can be effectively prevented. When the coating solution is applied to form a relatively thick wet coating of 10 μm or more thickness, the coating solution can be applied without pressing the die coater against the backing sheet, so that streaks or the like can be effectively prevented from being formed on the backing sheet. When the coating solution is applied to form a wet coating of 150 μm or less thickness, the drying time can be prevented from being too long, which makes it easy to keep the surface of the coating solution smooth and makes it possible to prevent an increase in the cost required for drying.

The coating solution applied to the backing sheet preferably has a weight percent solid concentration of 5 to 70%.

According to the invention, when the weight percent concentration of the solids in the coating solution is from 5 to 70%, defects can be effectively prevented from occurring, for example, with a water-based coating solution.

The invention is directed to an apparatus for applying a coating solution to a first surface of a flexible backing sheet from a discharge port of a die coater, wherein the backing sheet is being fed, and the discharge port linearly extends along a transverse direction perpendicular to the direction of feed of the backing sheet. The apparatus includes a roller that is configured to feed the backing sheet as it rotates while its outer surface comes into contact with a second surface of the backing sheet, wherein the second surface is opposite to the first surface to which the coating solution is to be applied, and also includes the die coater having the discharge port located downstream relative to the roller, the die coater being for applying the coating solution to the first surface of the backing sheet from the discharge port, wherein when a virtual line is drawn to pass through the discharge port of the die coater and to extend perpendicular to the backing sheet, the distance between a starting line and a boundary line is 50 mm or less, wherein the starting line is defined as a line intersecting with the virtual line on the second surface of the backing sheet, and the boundary line is defined as a line at a boundary where the second surface of the backing sheet begins to separate, upstream of the starting line, from the outer surface of the roller as the roller rotates, and the distance between the starting line and a line on the roller is 5 μm or more, wherein the line on the roller is defined as a line intersecting with the virtual line on the outer surface of the roller.

The invention is directed to another apparatus for applying a coating solution to a first surface of a flexible backing sheet from a discharge port of a die coater, wherein the backing sheet is being fed, and the discharge port linearly extends along a transverse direction perpendicular to the direction of feed of the backing sheet. The apparatus includes a roller that is configured to feed the backing sheet as it rotates while its outer surface comes into contact with a second surface of the backing sheet, wherein the second surface is opposite to the first surface to which the coating solution is to be applied, and also includes the die coater having the discharge port located upstream relative to the roller, the die coater being for applying the coating solution to the first surface of the backing sheet from the discharge port, wherein when a virtual line is drawn to pass through the discharge port of the die coater and to extend perpendicular to the backing sheet, the distance between a starting line and a boundary line is 50 mm or less, wherein the starting line is defined as a line intersecting with the virtual line on the second surface of the backing sheet, and the boundary line is defined as a line at a boundary where the second surface of the backing sheet begins to contact, downstream of the starting line, the outer surface of the roller, and the distance between the starting line and a line on the roller is 5 μm or more, wherein the line on the roller is defined as a line intersecting with the virtual line on the outer surface of the roller.

The coating solution is preferably applied to the backing sheet to form a wet coating with a thickness of 10 μm to 150 μm.

The coating solution applied to the backing sheet preferably has a weight percent solid concentration of 5 to 70%.

The invention is directed to a method for manufacturing a coated product, including applying a coating solution to a backing sheet by the method stated above to manufacture a coated product including the backing sheet and a coating formed thereon by applying the coating solution.

MODE FOR CARRYING OUT THE INVENTION

Figure 1:
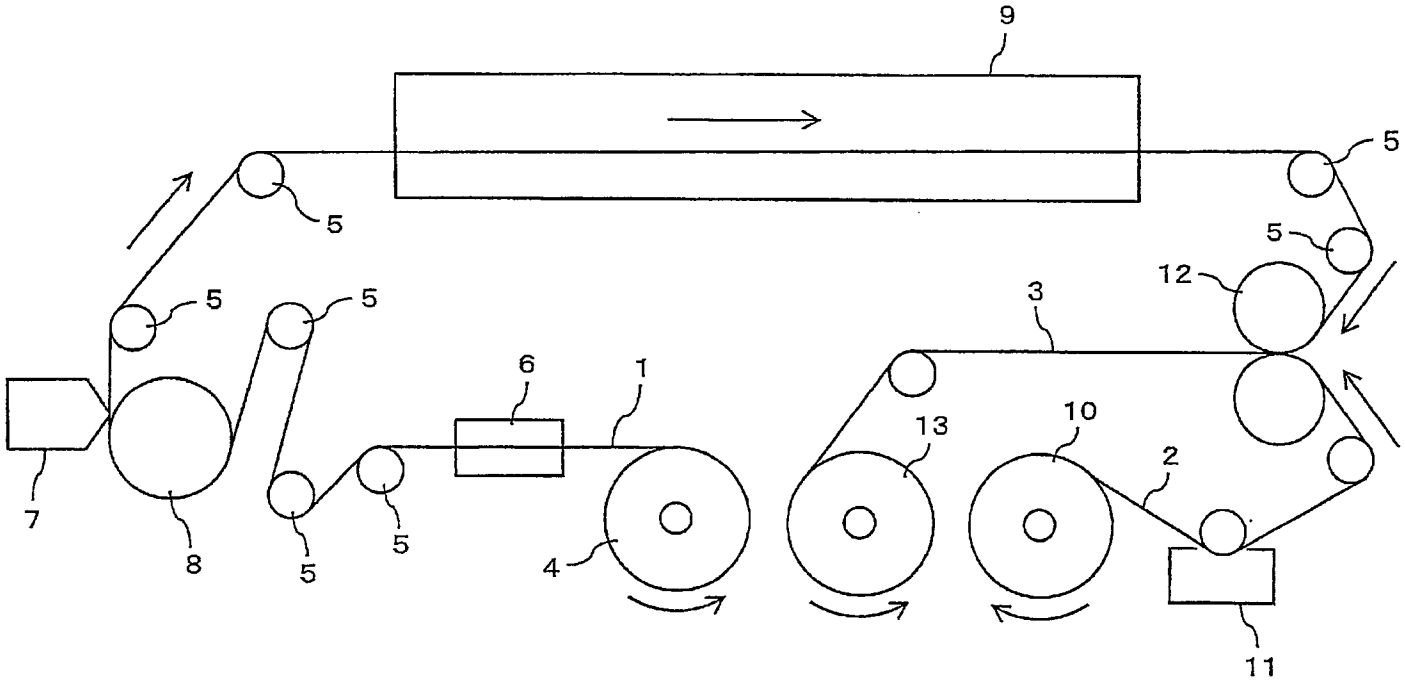
FIG. 1 is a schematic diagram showing an example of an apparatus according to an embodiment of the invention for applying a coating solution.

FIG. 1 is a schematic diagram showing an example of an apparatus according to an embodiment of the invention for applying a coating solution. In this embodiment, the applying apparatus is used in a process including applying a coating solution to a flexible backing sheet 1, then curing the coating solution by drying or any other method to form a coating layer, and placing a film member 2 on the surface of the coating layer to form a laminate, which is a long sheet material 3. In this embodiment, therefore, the method for applying a coating solution is used to produce a coated product including the backing sheet 1 and a coating thereon, which is formed by applying the coating solution thereto. It will be understood that the invention is applicable not only to such an apparatus but also to various other apparatuses capable of applying a coating solution to the backing sheet 1.

For example, the backing sheet 1 may be a film made of a transparent polymer, such as a polyester polymer such as polyethylene terephthalate or polyethylene naphthalate, a cellulose polymer such as diacetyl cellulose or triacetyl cellulose, a polycarbonate polymer, or an acryl-based polymer such as poly(methyl methacrylate). The backing sheet 1 may also be a film made of another transparent polymer, such as a styrene polymer such as polystyrene or an acrylonitrile-styrene copolymer, an olefin polymer such as polyethylene, polypropylene, a cyclic structure- or norbornene structure-containing polyolefin, or an ethylene-propylene copolymer, a vinyl chloride polymer, or an amide polymer such as nylon or aromatic polyamide. The backing sheet 1 may also be a film made of a further transparent polymer, such as an imide polymer, a sulfone polymer, a polyether sulfone polymer, a polyether ether ketone polymer, a polyphenylene sulfide polymer, a vinyl alcohol polymer, a vinylidene chloride polymer, a vinyl butyral polymer, an arylate polymer, a polyoxymethylene polymer, an epoxy polymer, or any blend of the above polymers. Particularly for optical applications, a transparent and less birefringent film is preferably used as the backing sheet 1.

However, it will be understood that the backing sheet 1 is not restricted to the above and may be a flexible support made of any of various other materials. In this example, the backing sheet 1, which is made of a long plastic film, has been wound into a roll 4, and the coating solution is applied to a first surface of the backing sheet 1 while the backing sheet 1 is unwound from the roll 4 and fed. The backing sheet 1 unwound from the roll 4 is fed by a plurality of feed rollers 5. For example, the speed at which the backing sheet 1 is fed (corresponding to the coating speed) is preferably, but not limited to, about 5 to about 300 m/minute.

The thickness of the backing sheet 1, which may be determined as needed, is preferably from 20 to 100 μm, more preferably from 25 to 80 μm. The backing sheet 1 with a thickness of 20 μm or more is relatively thick and thus can be easily and stably kept flat under the pressure of the coating solution. The backing sheet 1 with a thickness of 100 μm or less is preferred in view of stability during feeding, economy, and relatively small environmental loading.

The backing sheet 1 being unwound from the roll 4 is subjected to a pretreatment using a pretreatment apparatus 6. For example, the pretreatment may be a surface modification treatment such as a corona treatment, a plasma treatment, a sputtering treatment, a saponification treatment with an aqueous alkali solution, or ITRO treatment, or a rubbing treatment, or the like. It will be understood that the pretreatment apparatus 6 may be omitted.

After the pretreatment, the coating solution is applied to the backing sheet 1 using a die coater 7. A backup roller 8 is provided at a position opposed to the die coater 7. While a second surface of the backing sheet 1, which is opposite to the first surface to be coated with the coating solution, is brought into contact with the outer surface of the backup roller 8, the backing sheet 1 is fed as the backup roller 8 rotates, and the coating solution is applied to the first surface of the backing sheet 1 using the die coater 7. In this process, a feed roller 5, which is provided immediately downstream of the backup roller 8 along the direction of feed of the backing sheet 1, functions as a support roller to support the feed of the backing sheet 1 on the backup roller 8. The backup roller 8 is rotated by power transmitted from a driving source such as a motor (not shown). The backing sheet 1 is fed under tension. The coating solution is applied to the surface of the backing sheet 1 being fed under the tension. The tension is preferably from 5 to 200 N/m, more preferably from 20 to 150 N/m.

For example, the backup roller 8 may be an elastic roller in which at least its outer surface is elastic. In this example, the backup roller 8 has a metal core coated with an elastic layer made of a rubber layer or a resin layer. The core is made of a metal material, such as iron, stainless steel, titanium, or aluminum. A metal roll, specifically, an iron roll, is preferred. The hardness of the elastic layer is preferably from about 50 to about 80° because it should have a lower limit for reliable elasticity and have an upper limit for the prevention of scratching of the surface of the backing sheet 1. The elastic layer to be used preferably has a hardness of 60° or more, more preferably 70° or more. For example, the hardness can be measured by the method provided in JIS K 6253 (1997).

For example, the backup roller 8 to be used typically has a diameter of about 100 to about 500 mm, preferably 150 to 350 mm. The thickness of the elastic layer is typically from about 3 to about 50 mm, preferably from 5 to 20 mm. The backup roller 8 does not necessarily have an elastic layer at the outer surface, and, for example, its outer surface is preferably made of a metal.

The coating solution may be of any type capable of being discharged from the die coater 7 and capable of forming a coating layer, and the coating solution may be selected depending on the desired function of the coaling layer. Examples of the coating layer that can be made from the coating solution include a variety of optical functional layers such as polarizing layers, optical compensation layers, retardation layers, hard coating layers, anti-reflection layers, and antiglare layers, antistatic layers, surface protecting layers, conductive functional layers, pressure-sensitive adhesive layers, adhesive layers, transparent coating layers, anchor layers, and oligomer blocking layers. The pretreatment apparatus 6 can be used to perform an appropriate pretreatment depending on the type of the coating solution.

The coating solution to be used may be any of various types, such as a water-based coating solution such as an aqueous solution, an aqueous dispersion, or an emulsion; a solvent-based coating solution such as an organic solvent-containing solution; a high-solid type coating solution; and a solvent-free coating solution.

The coating solution contains any of various coating layer-forming materials depending on the type of the coating layer. Examples of coating layer-forming materials include thermoplastic resin, thermosetting resin, ultraviolet-ray curing-type resin, electron beam-curable resin, two part resin, and other base materials. The curable resins may include not only polymers but also monomers and oligomers. In addition to the base material, the coating solution may contain any of various viscosity modifiers, release modifiers, tackifiers, plasticizers, softeners, glass fibers, glass beads, metal powders, fillers made of other inorganic powders, pigments, colorants (such as pigments and dyes), pH regulators (acids or bases), antioxidants, ultraviolet absorbers, and silane coupling agents.

As mentioned above, various types of coating solutions may be used in the method of application of the invention. Hereinafter, cases using an aqueous dispersion-type pressure-sensitive adhesive are described in detail as typical examples. Aqueous dispersion type pressure-sensitive adhesives can have a higher weight percent solid concentration than solvent-type pressure-sensitive adhesives and can have a viscosity set within a relatively small range. Thus, the coating solution for use in the method of application of the invention is preferably an aqueous dispersion-type pressure-sensitive adhesive.

The aqueous dispersion-type pressure-sensitive adhesive is an aqueous dispersion containing at least a base polymer dispersed in water. Usually, the aqueous dispersion to be used contains a base polymer dispersed in the presence of a surfactant. However, an aqueous dispersion containing a self-dispersible base polymer dispersed by itself in water may also be used as long as the aqueous dispersion contains a base polymer dispersed in water.

The base polymer in the aqueous dispersion may be a product obtained by emulsion polymerization of a monomer or monomers in the presence of an emulsifier or a product obtained by dispersion polymerization of a monomer or monomers in the presence of a surfactant.

The aqueous dispersion may also be produced by dispersing and emulsifying a base polymer in water in the presence of an emulsifier, in which the base polymer has been produced separately. The emulsifying method may be a method including uniformly dispersing and emulsifying a polymer and an emulsifier, which may or may not have previously been melted by heating, with water using a mixer, such as a pressure kneader, a colloid mill, or a high-speed stirring shaft, under high shearing, and then cooling the mixture in such a manner that the dispersed particles do not fuse or aggregate, so that a desired aqueous dispersion is obtained (high-pressure emulsification method); a method including previously dissolving a polymer in an organic solvent such as benzene, toluene, or ethyl acetate, then adding the emulsifier and water to the solution, uniformly dispersing and emulsifying the mixture typically using a high-speed homogenizer under high shearing, and then removing the organic solvent by a heat treatment under reduced pressure or other methods to form a desired aqueous dispersion (solvent solution method); or the like.

The aqueous dispersion-type pressure-sensitive adhesive to be used may be of any type such as a rubber-based pressure-sensitive adhesive, an acryl-based pressure-sensitive adhesive, a silicone-based pressure-sensitive adhesive, a polyurethane-based pressure-sensitive adhesive, a vinyl alkyl ether-based pressure-sensitive adhesive, a polyvinyl alcohol-based pressure-sensitive adhesive, a polyvinylpyrrolidone-based pressure-sensitive adhesive, a polyacrylamide-based pressure-sensitive adhesive, a cellulose-based pressure-sensitive adhesive, a polyester-based pressure-sensitive adhesive, or a fluoride-based pressure-sensitive adhesive. The pressure-sensitive adhesive base polymer or the dispersing means is selected depending on the type of the pressure-sensitive adhesive.

Among the above pressure-sensitive adhesives, an aqueous dispersion-type acryl-based pressure-sensitive adhesive is preferably used in the invention because it has a high level of optical transparency and weather resistance or heat resistance and exhibits appropriate wettability and pressure-sensitive adhesive properties such as appropriate cohesiveness and tackiness.

An aqueous dispersion-type acrylic pressure-sensitive adhesive includes a (meth)acryl-based polymer as a base polymer. For example, such a (meth)acryl-based polymer can be obtained in the form of a copolymer emulsion by emulsion polymerization of monomers, which include alkyl(meth) acrylate as a principal monomer, in the presence of an emulsifier and a radical polymerization initiator. The term "alkyl (meth)acrylate" refers to alkyl acrylate and/or alkyl methacrylate, and "(meth)" is used in the same meaning in the description.

For example, the alkyl(meth)acrylate used to form the main skeleton of the (meth)acryl-based polymer may have a straight or branched chain alkyl group of 1 to 20 carbon atoms. For example, the alkyl group may be methyl, ethyl, propyl, isopropyl, n-butyl, isobutyl, sec-butyl, tert-butyl, pentyl, neopentyl, isoamyl, hexyl, heptyl, 2-ethylhexyl, isooctyl, nonyl, isononyl, decyl, isodecyl, dodecyl, tridecyl, tetradecyl, pentadecyl, hexadecyl, heptadecyl, octadecyl, nonadecyl, or eicosyl. These may be used alone or in any combination. The average number of carbon atoms in such alkyl groups is preferably from 3 to 9. Particularly in the invention, a monomer having a boiling point higher than that of water, such as butyl acrylate, is preferably used as the alkyl(meth)acrylate.

Besides the alkyl(meth)acrylate, one or more copolymerizable monomers having an unsaturated double bond-containing polymerizable functional group such as a (meth)acryloyl group or a vinyl group may be incorporated into the (meth)acryl-based polymer by copolymerization for purposes such as stabilization of the aqueous dispersion, improvement in the adhesion of the pressure-sensitive adhesive layer to the backing material such as an optical film, and improvement in the initial tackiness to adherends.

Examples of the copolymerizable monomer include, but are not limited to, carboxyl group-containing monomers such as (meth)acrylic acid, itaconic acid, maleic acid, fumaric acid, crotonic acid, carboxyethyl acrylate, and carboxypentyl acrylate; acid anhydride group-containing monomers such as maleic anhydride and itaconic anhydride; alicyclic hydrocarbon esters of (meth)acrylic acid, such as cyclohexyl(meth) acrylate, bornyl(meth)acrylate, and isobornyl(meth)acrylate; aryl(meth)acrylate such as phenyl(meth)acrylate; vinyl esters such as vinyl acetate and vinyl propionate; styrene monomers such as styrene and α-methylstyrene; epoxy group-containing monomers such as glycidyl(meth)acrylate and methylglycidyl(meth)acrylate; hydroxyl group-containing monomers such as 2-hydroxyethyl(meth)acrylate, 2-hydroxypropyl(meth)acrylate, and 4-hydroxybutyl(meth)acrylate; nitrogen atom-containing monomers such as (meth)acrylamide, N,N-dimethyl(meth)acrylamide, N,N-diethyl(meth)acrylamide, N-isopropyl(meth)acrylamide, N-butyl(meth)acrylamide, N-methylol(meth)acrylamide, N-methylolpropane(meth)acrylamide, (meth)acryloylmorpholine, aminoethyl(meth)acrylate, N,N-dimethylaminoethyl(meth)acrylate, and tert-butylaminoethyl(meth)acrylate; alkoxy group-containing monomers such as methoxyethyl(meth)acrylate and ethoxyethyl(meth)acrylate; cyano group-containing monomers such as acrylonitrile and methacrylonitrile; functional monomers such as 2-methacryloyloxyethyl isocyanate; olefin monomers such as ethylene, propylene, isoprene, butadiene, and isobutylene; vinyl ether monomers such as vinyl ether; halogen atom-containing monomers such as vinyl chloride; and other monomers including vinyl group-containing heterocyclic compounds such as N-vinylpyrrolidone, N-(1-methylvinyl)pyrrolidone, N-vinylpyridine, N-vinylpiperidone, N-vinylpyrimidine, N-vinylpiperazine, N-vinylpyrazine, N-vinylpyrrole, N-vinylimidazole, N-vinyloxazole, and N-vinylmorpholine, and N-vinylcarboxylic acid amides.

Examples of the copolymerizable monomer also include maleimide monomers such as N-cyclohexylmaleimide, N-isopropylmaleimide, N-laurylmaleimide, and N-phenylmaleimide; itaconimide monomers such as N-methylitaconimide, N-ethylitaconimide, N-butylitaconimide, N-octylitaconimide, N-2-ethylhexylitaconimide, N-cyclohexylitaconimide, and N-laurylitaconimide; succinimide monomers such as N-(meth)acryloyloxymethylenesuccinimide, N-(meth)acryloyl-6-oxyhexamethylenesuccinimide, and N-(meth)acryloyl-8-oxyoctamethylenesuccinimide; and sulfonic acid group-containing monomers such as styrenesulfonic acid, allylsulfonic acid, 2-(meth)acrylamido-2-methylpropanesulfonic acid, (meth)acrylamidopropanesulfonic acid, sulfopropyl(meth)acrylate, and (meth)acryloyloxynaphthalenesulfonic acid.

The copolymerizable monomer may also be a phosphate group-containing monomer. For example, the phosphate group-containing monomer may be a phosphate group-containing monomer represented by the following formula (1):

[Formula 1]

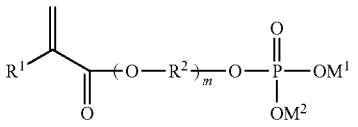

(1)

wherein $R^1$ represents a hydrogen atom or a methyl group, $R^2$ represents an alkylene group of 1 to 4 carbon atoms, m represents an integer of 2 or more, and $M^1$ and $M^2$ each independently represent a hydrogen atom or a cation, or a salt thereof.

In formula (1), m is 2 or more, preferably 4 or more, and generally 40 or less, and m represents the degree of polymerization of the oxyalkylene groups. For example, the polyoxyalkylene group may be a polyoxyethylene group or a polyoxypropylene group, and these polyoxyalkylene groups may include random, block, or graft units. The cation of the salt of the phosphate group is typically, but not limited to, an inorganic cation such as an alkali metal such as sodium or potassium or an alkaline-earth metal such as calcium or magnesium, or an organic cation such as a quaternary amine.

Examples of the copolymerizable monomer also include glycol acrylate monomers such as polyethylene glycol(meth)acrylate, polypropylene glycol(meth)acrylate, methoxyethylene glycol(meth)acrylate, and methoxypolypropylene glycol(meth)acrylate; and other monomers such as acrylic ester monomers containing a heterocyclic ring or a halogen atom, such as tetrahydrofurfuryl(meth)acrylate and fluoro(meth)acrylate.

The copolymerizable monomer may also be a silicone-modified unsaturated monomer. Silicone-modified unsaturated monomers include silicone-modified (meth)acrylate monomers and silicone-modified vinyl monomers. Examples of silicone-modified (meth)acrylate monomers include (meth)acryloyloxyalkyl-trialkoxysilanes such as (meth)acryloyloxymethyl-trimethoxysilane, (meth)acryloyloxymethyl-triethoxysilane, 2-(meth)acryloyloxyethyl-trimethoxysilane, 2-(meth)acryloyloxyethyl-triethoxysilane, 3-(meth)acryloyloxypropyl-trimethoxysilane, 3-(meth)acryloyloxypropyl-triethoxysilane, 3-(meth)acryloyloxypropyl-tripropoxysilane, 3-(meth)acryloyloxypropyl-triisopropoxysilane, and 3-(meth)acryloyloxypropyl-tributoxysilane; (meth)acryloyloxyalkyl-alkyldialkoxysilanes such as (meth)acryloyloxymethyl-methyldimethoxysilane, (meth)acryloyloxymethyl-methyldiethoxysilane, 2-(meth)acryloyloxyethyl-methyldimethoxysilane, 2-(meth)acryloyloxyethyl-methyldiethoxysilane, 3-(meth)acryloyloxypropyl-methyldimethoxysilane, 3-(meth)acryloyloxypropyl-methyldiethoxysilane, 3-(meth)acryloyloxypropyl-methyldipropoxysilane, 3-(meth)acryloyloxypropyl-methyldiisopropoxysilane, 3-(meth)acryloyloxypropyl-methyldibutoxysilane, 3-(meth)acryloyloxypropyl-ethyldimethoxysilane, 3-(meth)acryloyloxypropyl-ethyldiethoxysilane, 3-(meth)acryloyloxypropyl-ethyldipropoxysilane, 3-(meth)acryloyloxypropyl-ethyldiisopropoxysilane, 3-(meth)acryloyloxypropyl-ethyldibutoxysilane, 3-(meth)acryloyloxypropyl-propyldimethoxysilane, and 3-(meth)acryloyloxypropyl-propyldiethoxysilane; and (meth)acryloyloxyalkyl-dialkyl(mono)alkoxysilanes corresponding to these monomers. Examples of silicone-modified vinyl monomers include vinyltrialkoxysilanes such as vinyltrimethoxysilane, vinyltriethoxysilane, vinyltripropoxysilane, vinyltriisopropoxysilane, and vinyltributoxysilane, and vinylalkyldialkoxysilanes and vinyldialkylalkoxysilanes corresponding thereto; vinylalkyltrialkoxysilanes such as vinylmethyltrimethoxysilane, vinylmethyltriethoxysilane, β-vinylethyltrimethoxysilane, β-vinylethyltriethoxysilane, γ-vinylpropyltrimethoxysilane, γ-vinylpropyltriethoxysilane, γ-vinylpropyltripropoxysilane, γ-vinylpropyltriisopropoxysilane, and γ-vinylpropyltributoxysilane, and (vinylalkyl)alkyldialkoxysilanes and (vinylalkyl)dialkyl(mono)alkoxysilanes corresponding thereto.

A polyfunctional monomer may also be used as the copolymerizable monomer for a purpose such as control of the gel fraction of the aqueous dispersion-type pressure-sensitive adhesive. The polyfunctional monomer may be a compound having two or more unsaturated double bonds such as those in (meth)acryloyl groups or vinyl groups. Examples of such a polyfunctional monomer include (meth)acrylic esters of polyhydric alcohols, such as (mono or poly)alkylene glycol di(meth)acrylates including (mono or poly)ethylene glycol di(meth)acrylates such as ethylene glycol di(meth)acrylate, diethylene glycol di(meth)acrylate, triethylene glycol di(meth)acrylate, trimethylolpropane tri(meth)acrylate, and tetraethylene glycol di(meth)acrylate, (mono or poly)propylene glycol di(meth)acrylate such as propylene glycol di(meth)acrylate, neopentyl glycol di(meth)acrylate, 1,6-hexanediol di(meth)acrylate, pentaerythritol di(meth)acrylate, trimethylolpropane tri(meth)acrylate, pentaerythritol tri(meth)acrylate, and dipentaerythritol hexa(meth)acrylate; polyfunctional vinyl compounds such as divinylbenzene; and compounds having a reactive unsaturated double bond, such as allyl(meth)acrylate and vinyl(meth)acrylate. The polyfunctional monomer may also be a compound such as polyester (meth)acrylate, epoxy(meth)acrylate, or urethane (meth)acrylate having a polyester, epoxy, or urethane skeleton to which two or more unsaturated double bonds are added in the form of functional groups such as (meth)acryloyl groups or vinyl groups in the same manner as the above monomers.

Among these copolymerizable monomers, carboxyl group-containing monomers such as acrylic acid, phosphate group-containing monomers, or silicone-modified unsaturated monomers are preferably used to form a stable aqueous dispersion (emulsion or the like) or to ensure that the pressure-sensitive adhesive layer made from the aqueous dispersion can reliably adhere to an adherend, specifically, a glass panel.

The (meth)acryl-based polymer may include alkyl(meth)acrylate as a main component, and the content of the alkyl (meth)acrylate component may be 50% by weight or more, preferably 60% by weight or more, more preferably 70% by weight or more, based on the total amount of all monomer components. The upper limit of the content is typically, but not limited to, 100% by weight, preferably 99% by weight, more preferably 98% by weight. If the content of the alkyl (meth)acrylate component is less than 50% by weight, the adhesive properties of the pressure-sensitive adhesive layer, such as the adhesive strength, may be degraded.

The content of the copolymerizable monomer is typically less than 50% by weight, preferably less than 40% by weight, more preferably less than 30% by weight, based on the total amount of all monomer components. The content of the copolymerizable monomer may be appropriately selected depending on the type of each copolymerizable monomer. Based on the total amount of all monomers, for example, the content of a carboxyl group-containing monomer as a copolymerizable monomer is preferably from 0.1 to 6% by weight, the content of a phosphate group-containing monomer is preferably from 0.5 to 5% by weight, and the content of a silicone-modified unsaturated monomer is preferably from 0.005 to 0.2% by weight.

The emulsion polymerization of the monomers may be performed by a conventional method including emulsifying the monomers in water and then subjecting the emulsion to emulation polymerization. This method prepares an aqueous dispersion of a (meth)acryl-based polymer. In the emulsion polymerization, for example, the monomers are appropriately mixed in water with an emulsifier, a radical polymerization initiator, and an optional agent such as a chain transfer agent. More specifically, for example, a known emulsion polymerization method may be employed, such as a batch mixing method (batch polymerization method), a monomer dropping method, or a monomer emulsion dropping method. In a monomer dropping method or a monomer emulsion dropping method, continuous dropping or divided dropping is appropriately selected. These methods may be combined as needed. Reaction conditions and other conditions are appropriately selected, in which, for example, the polymerization temperature is from about 0 to about 150° C., and the polymerization time is from about 2 to about 15 hours.

The emulsifier is not particularly limited and may be any of various types of emulsifiers commonly used for emulsion polymerization. Examples of the emulsifier include anionic emulsifiers such as sodium lauryl sulfate, ammonium lauryl sulfate, sodium dodecylbenzenesulfonate, sodium polyoxyethylene lauryl sulfate, sodium polyoxyethylene alkyl ether sulfate, ammonium polyoxyethylene alkyl phenyl ether sulfate, sodium polyoxyethylene alkyl phenyl ether sulfate, and sodium polyoxyethylene alkyl sulfosuccinate; and nonionic emulsifiers such as polyoxyethylene alkyl ether, polyoxyethylene alkyl phenyl ether, polyoxyethylene fatty acid ester, and polyoxyethylene-polyoxypropylene block polymers. Other examples include radically-polymerizable emulsifiers prepared by introducing a radically-polymerizable functional group (radically reactive group) such as a propenyl group or an allyl ether group into the anionic surfactants or the nonionic surfactants. These emulsifiers may be appropriately used alone or in any combination. Among these emulsifiers, radically-polymerizable emulsifiers having a radically-polymerizable functional group are preferably used to form a stable aqueous dispersion (emulsion) or to form a durable pressure-sensitive adhesive layer.

For example, the content of the emulsifier may be from about 0.1 to about 5 parts by weight, preferably from 0.4 to 3 parts by weight, based on 100 parts by weight of the monomers including the alkyl(meth)acrylate as a principal monomer. When the emulsifier content is in this range, water resistance, pressure-sensitive adhesive properties, and stability such as polymerization stability or mechanical stability can be improved.

The radical polymerization initiator is not particularly limited and may be any known radical polymerization initiator commonly used for emulsion polymerization. Examples include azo initiators such as 2,2'-azobisisobutylonitrile, 2,2'-azobis(2-methylpropionamidine)disulfate, 2,2'-azobis(2-methylpropionamidine)dihydrochloride, 2,2'-azobis(2-amidinopropane)dihydrochloride, and 2,2'-azobis[2-(2-imidazoline-2-yl)propane]dihydrochloride; persulfate initiators such as potassium persulfate and ammonium persulfate; peroxide initiators such as benzoyl peroxide, tert-butyl hydroperoxide, and hydrogen peroxide; substituted ethane initiators such as phenyl-substituted ethane; and carbonyl initiators such as aromatic carbonyl compounds. Among these radical polymerization initiators, azo radical polymerization initiators are preferred because they can improve the transparency of the pressure-sensitive adhesive layer formed according to the invention. These polymerization initiators may be appropriately used alone or in any combination. The content of the radical polymerization initiator, which may be selected as desired, is typically from about 0.02 to about 0.5 parts by weight, preferably from 0.08 to 0.3 parts by weight, based on 100 parts by weight of the monomers. If it is less than 0.02 parts by weight, the radical polymerization initiator may be less effective. If it is more than 0.5 parts by weight, the (meth)acryl-based polymer in the form of an aqueous dispersion may have a lower molecular weight, and the aqueous dispersion-type pressure-sensitive adhesive composition may have lower pressure-sensitive adhesive properties.

If necessary, a chain transfer agent may be used to control the molecular weight of the (meth)acryl-based polymer in the form of an aqueous dispersion. In general, the chain transfer agent may be one commonly used in the art. Examples include 1-dodecanthiol, mercaptoacetic acid, 2-mercaptoethanol, 2-ethylhexyl thioglycolate, 2,3-dimercapto-1-propanol, mercaptopropionic acid esters, and other mercaptans. These chain transfer agents may be appropriately used alone or in any combination. For example, the content of the chain transfer agent is from 0.001 to 0.3 parts by weight based on 100 parts by weight of the monomers.

Such emulsion polymerization makes it possible to prepare a (meth)acryl-based polymer in the form of an aqueous dispersion (emulsion). The average particle size of such an aqueous dispersion-type (meth)acryl-based polymer is typically adjusted to 0.05 to 3 μm, preferably to 0.05 to 1 μm. If the average particle size is less than 0.05 μm, the viscosity of the aqueous dispersion-type pressure-sensitive adhesive may increase, and if it is more than 1 μm, adhesiveness between particles may decrease so that cohesive strength may decrease.

When the (meth)acryl-based polymer in the aqueous dispersion contains a carboxyl group-containing monomer component or the like as a copolymerized monomer component for maintaining the stability of the aqueous dispersion, the carboxyl group-containing monomer component or the like should preferably be neutralized. For example, the neutralization can be performed using ammonia, an alkali metal hydroxide, or the like.

In general, the water-dispersible (meth)acryl-based polymer according to the invention preferably has a weight average molecular weight of 1,000,000 or more. In particular, the weight average molecular weight is preferably from 1,000,000 to 4,000,000 in view of heat resistance or moisture resistance. If the weight average molecular weight is less than 1,000,000, an undesired reduction in heat resistance or moisture resistance may occur. The pressure-sensitive adhesive obtained by the emulsion polymerization is preferred because the polymerization mechanism allows the adhesive to have a very high molecular weight. It should be noted that the pressure-sensitive adhesive obtained by the emulsion polymerization usually has a high gel content and cannot be subjected to GPC (gel permeation chromatography) measurement, which means that it is often difficult to identify the molecular weight by actual measurement.

In the invention, the aqueous dispersion-type pressure-sensitive adhesive may contain a crosslinking agent in addition to the base polymer. When the aqueous dispersion-type pressure-sensitive adhesive is an aqueous dispersion-type acryl-based pressure-sensitive adhesive, a commonly used crosslinking agent such as an isocyanate crosslinking agent, an epoxy crosslinking agent, an oxazoline crosslinking agent, an aziridine crosslinking agent, a carbodiimide crosslinking agent, or a metal chelate crosslinking agent may be used therein. When a functional group-containing monomer is used, these crosslinking agents have the effect of reacting with the functional group incorporated in the polymer to form crosslinkage.

While the blending ratio of the crosslinking agent to the base polymer is not restricted, 10 parts by weight or less (solid basis) of the crosslinking agent is generally added to 100 parts by weight (solid basis) of the base polymer. The added amount of the crosslinking agent is preferably from 0.001 to 10 parts by weight, more preferably from 0.01 to 5 parts by weight.

Subsequently, the applied aqueous dispersion-type pressure-sensitive adhesive is dried to form a pressure-sensitive adhesive layer using a drying apparatus 9. The drying temperature is generally from about 80 to about 170° C., preferably from 80 to 160° C., and the drying time period is generally from about 0.5 to about 30 minutes, preferably from 1 to 10 minutes. When the backing sheet 1 passes through the drying apparatus 9, a coating layer is fixed on the first surface of the backing sheet 1, in which the coating layer has a thickness smaller than that of the coating solution applied in a wet state. In this example, a pressure-sensitive adhesive is used as the coating solution so that a pressure-sensitive adhesive layer is formed on the first surface of the backing sheet 1 after the drying. It will be understood that the coating solution is not limited to the type capable of being fixed on the first surface of the backing sheet 1 using the drying apparatus 9 and may be of any other type capable of being fixed thereon using, for example, a UV curing apparatus or any other fixing apparatus.

After the drying, a film member 2 is laminated to the backing sheet 1 with the pressure-sensitive adhesive layer interposed therebetween. The film member 2 may be an optical film such as a polarizing plate, a retardation plate, a viewing angle compensation film, or a brightness enhancement film. In this example, the film member 2 used is a polarizing plate including a polarizer, which is made using a polyvinyl alcohol-based film, and protective films placed on both sides of the polarizer. It will be understood that the film member 2 is not limited to a polarizing plate and may be any other optical film having other optical properties or may be a non-optical film.

The film member 2 is made of a long film having a width corresponding to that of the backing sheet 1. The film member 2 has been wound into a roll 10. An undercoat is applied to the film member 2 using an undercoating apparatus 11, while the film member 2 is unwound from the roll 10. To improve the adhesion between the pressure-sensitive adhesive layer and the film member 2, for example, an anchor layer may be formed on the film member 2, or the film member 2 may be subjected to any adhesion facilitating treatment such as a corona treatment or a plasma treatment, before the pressure-sensitive adhesive layer is formed. The surface of the pressure-sensitive adhesive layer may also be subjected to an adhesion facilitating treatment. It will be understood that the undercoating apparatus 11 may be omitted.

The backing sheet 1 and the film member 2 are bonded together by pressure when they are allowed to pass through between a pair of bonding rollers 12 in contact with each other, so that a sheet material 3 is formed, which is a laminate of the backing sheet 1 and the film member 2 with the pressure-sensitive adhesive layer interposed therebetween. The formed sheet material 3 is wound into a roll 13 to be supplied. The adhesive strength of the pressure-sensitive adhesive layer to the backing sheet 1 is lower than that to the film member 2. Thus, the pressure-sensitive adhesive layer is left on the film member 2 when the backing sheet 1 is peeled off from the sheet material 3.

Figure 2:
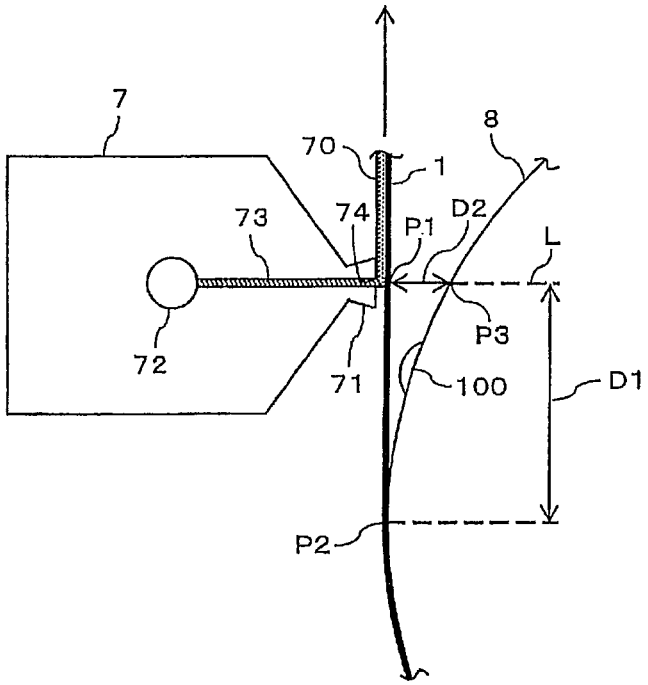
FIG. 2 is a schematic cross-sectional view for illustrating a way to apply a coating solution to a backing sheet.

FIG. 2 is a schematic cross-sectional view for illustrating the process of applying the coating solution 70 to the backing sheet 1. For example, the die coater 7 applies the coating solution 70 to the backing sheet 1 by discharging the coating solution 70 from a discharge port 74 formed at the front end of its lip 71 while the coating solution 70 is degassed using a stirring vacuum degasser or the like and fed to the die coater 7. The die coater 7 has a shape extending parallel to the transverse direction of the backing sheet 1 (the direction perpendicular to the feed direction). The discharge port 74 of the die coater 7, which linearly extends along the transverse direction, is formed to face a transverse part of the backing sheet 1 between one end and the other end and also formed having a width substantially equal to or longer than the width of the backing sheet 1.

A manifold 72 is formed inside the die coater 7. The manifold 72 includes a tube extending from one end to the other end in the longitudinal direction. The die coater 7 has a lip 71 formed at the face to be opposed to the backing sheet 1. The lip 71 includes a strip-shaped projection, which protrudes toward the backing sheet 1. The lip 71 extends from one end to the other end in the longitudinal direction of the die coater 7. In the die coater 7, therefore, the lip 71 and the manifold 72 are formed parallel to each other.

A groove 73 is formed inside the die coater 7. The manifold 72 communicates with the lip 71 through the groove 73. The groove 73 is formed to extend perpendicular to the backing sheet 1. The coating solution 70 is supplied to the lip 71 through the groove 73 and then applied to the first surface of the backing sheet 1 from the discharge port 74 formed at the front end of the lip 71. As described above, the discharge port 74 is placed to face a transverse part of the backing sheet 1 between one end and the other end. Thus, the coating solution 70 can be applied over the first surface of the backing sheet 1 by supplying the coating solution 70 from the die coater 7 to the first surface of the backing sheet 1 while feeding the backing sheet 1. The coating solution 70 is applied, along an application line, to the first surface of the backing sheet 1 from the discharge port 74 linearly extending along the transverse direction of the backing sheet 1. A starting line P1, which is described below, is defined as a line that is immediately across the backing sheet 1 from the application line and is located on the second surface of the backing sheet 1 opposite to its first surface. The starting line P1 is parallel to the application line and perpendicular to the direction of feed of the backing sheet 1. The starting line P1 extends in a direction perpendicular to the plane of FIG. 2.

Figure 3:
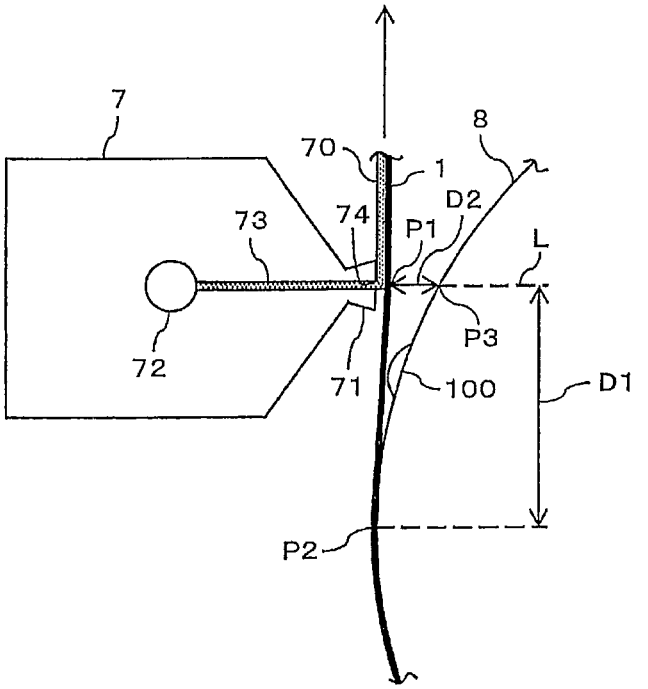
FIG. 3 is a schematic cross-sectional view for illustrating another way to apply a coating solution to a backing sheet.

The discharge port 74 formed at the front end of the lip 71 functions as an outlet for the coating solution 70. The discharge port 74 has a width along the direction of feed of the backing sheet 1. The width of the discharge port 74 is preferably in the range of 0.05 to 10 mm, more preferably in the range of 0.10 to 1 mm. It will be understood that the lip 71 may be designed to have any appropriate shape within the above range depending on the viscosity of the coating solution 70. In this embodiment, the front end of the lip 71 is configured not to be pressed against or not to come into contact with the first surface of the backing sheet 1 during the application of the coating solution. Alternatively, as shown in FIG. 3, the front end of the lip 71 may be pressed against the first surface of the backing sheet 1.

The die coater 7 may be a slot die coater, a slide coater, an extrusion coater, or the like. In this example, the die coater 7 used is a slot die coater. However, this is non-limiting, and the die coater 7 may be of any other type.

In this embodiment, the discharge port 74 of the die coater 7 is located downstream relative to the backup roller 8 in the process of applying the coating solution to the first surface of the backing sheet 1 from the discharge port 74. A virtual line L is drawn to pass through the discharge port 74 of the die coater 7 and to extend perpendicular to the backing sheet 1. The starting line P1 is defined as a line intersecting with the virtual line L on the second surface of the backing sheet 1. A boundary line P2 is defined as a line at a boundary where the second surface of the backing sheet 1 begins to separate, upstream of the starting line P1, from the outer surface of the backup roller 8 as the backup roller 8 rotates. The distance D1 between the starting line P1 and the boundary line P2 is 50 mm or less. The virtual line L passes through part of the disparage port 74 (for example, apart corresponding to the transverse center of the backing sheet 1) extending along the transverse direction of the backing sheet 1, extends perpendicular to the first surface of the backing sheet 1, and intersects with a line P3 on the outer surface of the backup roller 8. In FIG. 2, the starting line P1 is opposed parallel to the line P3 on the roller. The distance D2 between the starting line P1 and the line P3 on the roller is 5 μm or more, wherein the line P3 on the roller is defined as a line intersecting with the virtual line L on the outer surface of the backup roller 8. The distance D1 is preferably from 1 to 25 mm, more preferably from 1 to 5 mm. The distance D2 is preferably 8 μm or more, more preferably 15 μm or more. The distances D1 and D2 should each be equal to or less than the radius of the backup roller 8 so that the backing sheet 1 and the outer surface of the backup roller 8 can face each other in the direction of discharge of the coating solution 70 (the horizontal direction in FIG. 2).

When the virtual line L is drawn to pass through the discharge port 74 of the die coater 7 and to extend perpendicular to the backing sheet 1, the distance between the starting line P1 and the line P3 on the roller is 5 μm or more, wherein the starting line P1 is defined as a line intersecting with the virtual line L on the second surface of the backing sheet 1, and the line P3 on the roller is defined as a line intersecting with the virtual line L on the outer surface of the backup roller 8. This feature makes it possible to prevent a contaminant 100 from pushing the part of the backing sheet 1 where the coating solution 70 is being applied, even when the contaminant 100 is caught between the outer surface of the backup roller 8 and the backing sheet 1. Thus, this feature effectively prevents dented point defects, which would otherwise occur if the coating solution 70 is applied thinner at some points.

In addition, the distance D1 between the starting line P1 and the boundary line P2 is 50 mm or less, wherein the boundary line is defined as a line at a boundary where the second surface of the backing sheet 1 begins to separate, upstream of the starting line P1, from the outer surface of the backup roller 8 as the backup roller 8 rotates. Thus, the backing sheet 1 being fed is kept relatively flat as well as it is kept flat at the position of the boundary line P2. The discharge port 74 of the die coater 7 is placed at a position facing the starting line P1 on the backing sheet 1 kept in such a relatively flat state, and the coating solution 70 is applied to the first surface of the backing sheet 1 from the discharge port 74 placed at such a position. Thus, the surface of the coating solution on the backing sheet 1 can be made smooth even without significantly pressing the backing sheet 1 with the die coater 7. This can effectively prevent press-induced streaks.

Figure 4:
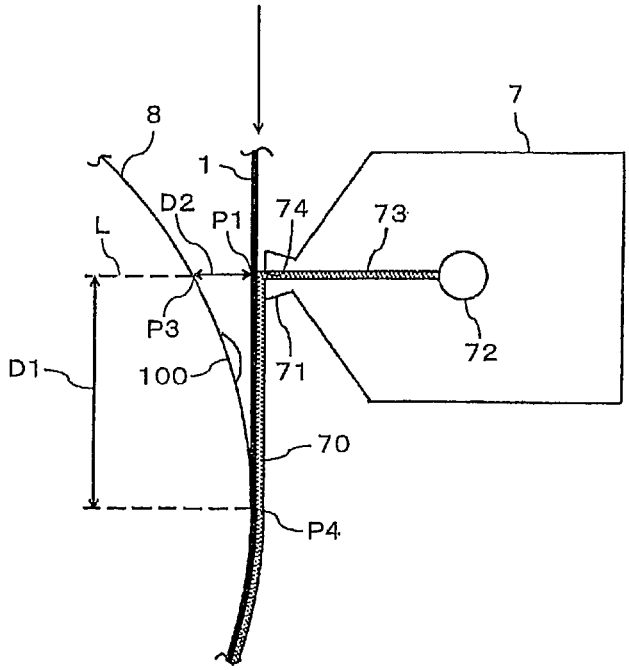
FIG. 4 is a schematic cross-sectional view for illustrating a further way to apply a coating solution to a backing sheet.
Figure 5:
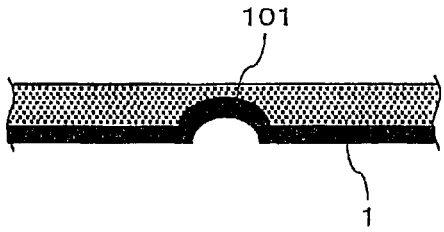
FIGS. 5(*a*)-(*c*) are schematic views for illustrating a case where a contaminant is caught between the outer surface of a backup roller and a backing sheet in the application of a coating solution.
Figure 5:
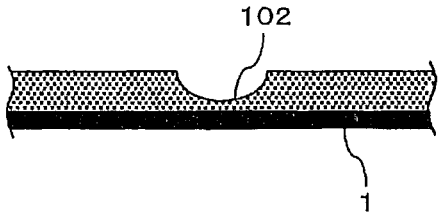
Figure 5:
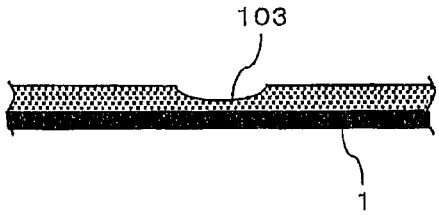

The die coater 7 does not always have to be provided downstream relative to the backup roller 8 with respect to the direction of feed of the backing sheet 1. As shown in FIG. 4, the discharge port 74 of the die coater 7, from which the coating solution is applied to the first surface of the backing sheet 1, may be provided upstream with respect to the direction of feed of the backing sheet 1. In this case, a virtual line L is drawn to pass through the discharge port 74 of the die coater 7 and to extend perpendicular to the backing sheet 1, and the distance D1 may be between the starting line P1 and a boundary line P4, wherein the starting line P1 is defined as a line intersecting with the virtual line L on the second surface of the backing sheet 1, and the boundary line P4 is defined as a line at a boundary where the second surface of the backing sheet 1 begins to contact, downstream of the starting line P1, the outer surface of the backup roller 8. In this case, a feed roller 5 is provided immediately upstream of the backup roller 8 with respect to the direction of feed of the backing sheet 1, and the feed roller 5 functions as a support roller to support the feed of the baking sheet 1 on the backup roller 8.

The wet thickness of the coating solution 70 applied to the backing sheet 1, namely, the thickness of the coating before drying with the drying apparatus 9, is preferably, but not limited to, 10 to 150 μm. When the coating solution 70 is applied to form such a relatively thick wet coating of 10 to 150

μm thickness, this embodiment can effectively prevent the occurrence of defects. When the coating solution 70 is applied to form a relatively thick wet coating of 10 μm or more thickness, the coating solution 70 can be applied without pressing the die coater 7 against the backing sheet 1, so that streaks or the like can be effectively prevented from being formed on the backing sheet 1. When the coating solution 70 is applied to form a wet coating of 150 μm or less thickness, the drying time can be prevented from being too long, which makes it easy to keep the surface of the coating solution 70 smooth and makes it possible to prevent an increase in the cost required for drying. The wet thickness of the coating solution 70 applied to the backing sheet 1 is more preferably from 30 to 150 μm.

The weight percent concentration (base) of the solids in the coating solution 70 to be applied to the backing sheet 1 is preferably, but not limited to, 5 to 70%. At such a concentration, defects can be effectively prevented from occurring, for example, with a water-based coating solution 70. When a water-based coating solution 70 is used, the base of the coating solution 70 is preferably from 20 to 60%, more preferably from 30 to 60%. Particularly to prevent dented defects from being formed on the surface of the coating solution 70, the base of the coating solution 70 is preferably 20% or more, more preferably 30% or more. When the base of the coating solution 70 is 70% or less, the viscosity of the coating solution 70 can be prevented from increasing significantly, which gives a good result. When the base of the coating solution 70 is relatively low, the wet coating tends to be relatively thick and easy to be leveled, so that the problem of dented defects remaining on the surface of the coating solution 70, which is caused by the presence of contaminants, is less likely to occur.

The viscosity of the coating solution 70 is preferably, but not limited to, 5 to 50,000 mPa·s, more preferably 100 to 20,000 mPa·s. When the water-based coating solution 70 is used, the viscosity of the coating solution 70 is preferably from 200 to 10,000 mPa·s, more preferably from 500 to 3,000 mPa·s. When the viscosity of the coating solution 70 is 5 mPa·s or more, the coating solution 70 is less vulnerable to perturbation caused by air flow or the like during drying, so that high smoothness can be easily achieved, which give a good result. When the viscosity of the coating solution 70 is 50,000 mPa·s or less, a stable bead can be easily formed, and streaks and other defects are less likely to occur, which gives a good result.

In view of the base and viscosity of the coating solution 70 as described above, the invention is particularly useful for application of a solution of a pressure-sensitive adhesive for optical applications. The invention can also be used to apply an aqueous dispersion-type pressure-sensitive adhesive (emulsion) or a high-solid type pressure-sensitive adhesive. In this case, high base can not only contribute to smoothness but also prevent dented defects, which is particularly useful for industry.

EXAMPLES

The apparatus shown in FIGS. 1 and 2 for applying the coating solution 70 was used to apply a pressure-sensitive adhesive to the backing sheet 1 under different sets of conditions, so that optical pressure-sensitive adhesive sheets (pressure-sensitive adhesive layer-carrying polarizing plates) were produced. It was observed whether or not dented defects and streaks occurred on the optical pressure-sensitive adhesive sheet produced under each set of conditions. The results of the observation are described below. In the process of producing the optical pressure-sensitive adhesive sheet, the pressure-sensitive adhesive was applied to a polyethylene terephthalate release film as the backing sheet 1 while the release film was fed using a backup roller (300 mm in diameter) and a support roller (100 mm in diameter). The pressure-sensitive adhesive was then dried using the drying apparatus 9. An optical film (polarizing plate) as the film member 2 was bonded to the dried pressure-sensitive adhesive layer, and then the resulting laminate was wound into a roll.

It was observed whether dented defects occurred on the optical pressure-sensitive adhesive sheet produced under each set of conditions. The observation was performed by visually counting dented defects on the polyethylene terephthalate release film-side surface of the laminate using reflected light. Typical dented defects were observed using WYKO NT3300 (a non-contact, three-dimensional, roughness meter manufactured by Veeco Instruments Inc.). The results of the observation showed that the typical dented defects were 3 to 5 mm in diameter and 1 to 2 μm in depth. The number of dented defects was counted per 1 m of the produced optical pressure-sensitive adhesive sheet. When the number of dented defects was 3/m or less, it was determined that the occurrence of dented defects was efficiently suppressed. The results are shown in Table 1 below.

It was also observed whether streaks occurred on the optical pressure-sensitive adhesive sheet produced under each set of conditions. The observation was performed by visually counting streak defects on the polyethylene terephthalate release film-side surface of the laminate using reflected light. The levels shown below were used in the observation of streaks. When the result of the observation was level 3 or higher level, it was determined that the occurrence of streak defects was efficiently suppressed. The results are shown in Table 1 below.

Level 1: Strong streaks are observed over the surface.

Level 2: 21 or more weak streaks are observed over the surface.

Level 3: 6 to 20 weak streaks are observed per 1 m.

Level 4: 1 to 5 weak streaks are observed per 1 m.

Level 5: No streaks are observed.

Example 1

In Example 1, an aqueous dispersion-type acryl-based pressure-sensitive adhesive was used as the coating solution 70. The aqueous dispersion-type acryl-based pressure-sensitive adhesive was prepared as follows. To a vessel were added 55,554 parts of butyl acrylate, 2,776 parts of acrylic acid, 1,665 parts of mono[poly(propylene oxide)methacrylate] phosphate ester (5.0 in average degree of polymerization of propylene oxide), and 5 parts of 3-methacryloyloxypropyltriethoxysilane (KBM-503 manufactured by Shin-Etsu Chemical Co., Ltd.) as starting materials, and mixed to form a monomer mixture. Subsequently, 1,300 parts of AQUALON HS-10 (manufactured by DAI-ICHI KOGYO SEIYAKU CO., LTD.) as a reactive surfactant and 38,700 parts of ion-exchanged water were added to 60,000 parts of the prepared monomer mixture. The resulting mixture was stirred at 7,000 rpm for 10 minutes using a homogenizer (manufactured by PRIMIX Corporation) to form a monomer emulsion. Subsequently, 20,000 parts of the monomer emulsion prepared as described above and 35,000 parts of ion-exchanged water were added to a reaction vessel equipped with a condenser tube, a nitrogen-introducing tube, a thermometer, a dropping funnel, and a stirring blade. Subsequently, after the air in the reaction vessel was sufficiently replaced by nitrogen gas, 10 parts of ammonium persulfate was added to the reaction vessel, and the mixture was subjected to polymerization at 60° C. for 1 hour. Subsequently, 80,000 parts of the remaining monomer emulsion was added dropwise to the reaction vessel over 3 hours, and then the mixture was subjected to polymerization for 3 hours. Subsequently, the mixture was further subjected to polymerization at 65° C. for 5 hours while the air was replaced by nitrogen gas, so that an aqueous dispersion-type pressure-sensitive adhesive solution with a solid concentration of 45% was obtained. Subsequently, after the emulsion solution was cooled to room temperature, 30 parts of 10% ammonia water was added to the emulsion solution. Distilled water was further added to the emulsion solution so that its solid concentration was adjusted to 39%. The viscosity of the resulting liquid was 2,000 mPa·s as measured using a Brookfield type viscometer (manufactured by Toki Sangyo Co., Ltd.) at 23° C. and a rotor speed of 20 rpm.

In Example 1, the distance D1 was set at 2.1 mm, and the distance D2 was set at 15 μm, when the coating solution 70 was applied to the first surface of the backing sheet 1 from the discharge port 74 of the die coater 7. The backing sheet 1 was 38 μm in thickness. The coating solution 70 was applied to form a 59-μm-thick wet coating. After dried at 120° C., the coating was 23 μm in thickness. In the application of the coating solution 70, the coating width was 1,250 mm, and the coating speed was 20 m/minute.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 5, which showed that the occurrence of streak defects was also effectively suppressed.

Example 2

In Example 2, the distance D1 was set at 3.5 mm, and the distance D2 was set at 40 μm, when the coating solution 70 was applied to the first surface of the backing sheet 1 from the discharge port 74 of the die coater 7. The other conditions were the same as those in Example 1.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 5, which showed that the occurrence of streak defects was also effectively suppressed.

Example 3

In Example 3, the distance D1 was set at 5.0 mm, and the distance D2 was set at 83 μm, when the coating solution 70 was applied to the first surface of the backing sheet 1 from the discharge port 74 of the die coater 7. The other conditions were the same as those in Example 1.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 5, which showed that the occurrence of streak defects was also effectively suppressed.

Example 4

In Example 4, the distance D1 was set at 24.0 mm, and the distance D2 was set at 1,930 μm, when the coating solution 70 was applied to the first surface of the backing sheet 1 from the discharge port 74 of the die coater 7. The other conditions were the same as those in Example 1.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 4, which showed that the occurrence of streak defects was also relatively effectively suppressed.

Example 5

In Example 5, the distance D1 was set at 48.0 mm, and the distance D2 was set at 7,890 μm, when the coating solution 70 was applied to the first surface of the backing sheet 1 from the discharge port 74 of the die coater 7. The other conditions were the same as those in Example 1.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 3, which showed that the occurrence of streak defects was also relatively suppressed.

Example 6

In Example 6, the distance D1 was set at 1.5 mm, and the distance D2 was set at 8 μm, when the coating solution 70 was applied to the first surface of the backing sheet 1 from the discharge port 74 of the die coater 7. The other conditions were the same as those in Example 1.

It was observed whether or not dented defects occurred on the prepared optical pressure-sensitive adhesive sheet. The result of the observation showed that dented defects were slightly formed but the occurrence of dented defects was relatively effectively suppressed. It was also observed whether or not streaks were formed on the prepared optical pressure-sensitive adhesive sheet. The result of the observation was level 5, which showed that the occurrence of streak defects was also effectively suppressed.

Example 7

In Example 7, the distance D1 was set at 48.0 mm, and the distance D2 was set at 7,890 μm, when the coating solution 70 was applied to the first surface of the backing sheet 1 from the discharge port 74 of the die coater 7. The backing sheet 1 was 75 μm in thickness. The other conditions were the same as those in Example 1.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 4, which showed that the occurrence of streak defects was also relatively effectively suppressed.

Example 8

In Example 8, the distances D1 and D2 were set at the same values as those in Example 1, when the coating solution 70 was applied to the first surface of the backing sheet 1 from the discharge port 74 of the die coater 7. The coating solution 70 was applied to form a 144-μm-thick wet coating. After dried at 120° C., the coating was 55 μm in thickness. The other conditions were the same as those in Example 1.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 5, which showed that the occurrence of streak defects was also effectively suppressed.

Example 9

In Example 9, the distances D1 and D2 were set at the same values as those in Example 1, when the coating solution 70 was applied to the first surface of the backing sheet 1 from the discharge port 74 of the die coater 7. The coating solution 70 was applied to form a 30-μm-thick wet coating. After dried at 120° C., the coating was 12 μm in thickness. The other conditions were the same as those in Example 1.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 3, which showed that the occurrence of streak defects was also relatively suppressed.

Example 10

In Example 10, a solvent-type acryl-based pressure-sensitive adhesive was used as the coating solution 70. A solution of 50,000 parts of butyl acrylate, 25 parts of acrylic acid, 25 parts of hydroxybutyl acrylate, and 100 parts of benzoyl peroxide in 120,000 parts of toluene was added to a reaction vessel equipped with a condenser tube, a nitrogen-introducing tube, a thermometer, a dropping funnel, and a stirring blade. Subsequently, after the air in the reaction vessel was sufficiently replaced by nitrogen gas, the mixture was allowed to react at about 70° C. for 3 hours, so that a solution containing an acryl-based polymer (solid concentration 30%) with a weight average molecular weight of 700,000 was obtained. Based on 100 parts of the polymer solid, 1.3 parts of Takenate D110N manufactured by Mitsui Takeda Polyurethane, Inc. (an isocyanate polyfunctional compound) was added to the acryl-based polymer solution. The viscosity of the resulting liquid was 11,000 mPa·s as measured using a Brookfield type viscometer (manufactured by Toki Sangyo Co., Ltd.) at 23° C. and a rotor speed of 20 rpm.

In Example 10, the distances D1 and D2 were set at the same values as those in Example 1, when the coating solution 70 was applied to the first surface of the backing sheet 1 from the discharge port 74 of the die coater 7. The backing sheet 1 was 38 μm in thickness. The coating solution 70 was applied to form a 77-μm-thick wet coating. After dried at 120° C., the coating was 23 μm in thickness. In the application of the coating solution 70, the coating width was 1,250 mm, and the coating speed was 20 m/minute.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 5, which showed that the occurrence of streak defects was also effectively suppressed.

Example 11

In Example 11, an aqueous dispersion-type acryl-based pressure-sensitive adhesive was used as the coating solution 70. The aqueous dispersion-type acryl-based pressure-sensitive adhesive was prepared as follows. To a vessel were added 55,554 parts of butyl acrylate, 1,667 parts of acrylic acid, 833 parts of mono[poly(propylene oxide)methacrylate]phosphate ester (5.0 in average degree of polymerization of propylene oxide), and 5 parts of 3-methacryloyloxypropyl-triethoxysilane (KBM-503 manufactured by Shin-Etsu Chemical Co., Ltd.) as starting materials, and mixed to form a monomer mixture. Subsequently, 871 parts of AQUALON HS-10 (manufactured by DAI-ICHI KOGYO SEIYAKU CO., LTD.) as a reactive surfactant and 24,011 parts of ion-exchanged water were added to 58,060 parts of the prepared monomer mixture. The resulting mixture was stirred at 7,000 rpm for 10 minutes using a homogenizer (manufactured by PRIMIX Corporation) to form a monomer emulsion. Subsequently, 10,000 parts of the monomer emulsion prepared as described above and 10,703 parts of ion-exchanged water were added to a reaction vessel equipped with a condenser tube, a nitrogen-introducing tube, a thermometer, a dropping funnel, and a stirring blade. Subsequently, after the air in the reaction vessel was sufficiently replaced by nitrogen gas, 10 parts of ammonium persulfate was added to the reaction vessel, and the mixture was subjected to polymerization at 60° C. for 1 hour. Subsequently, 72,941 parts of the remaining monomer emulsion was added dropwise to the reaction vessel over 3 hours, and then the mixture was subjected to polymerization for 3 hours. Subsequently, the mixture was further subjected to polymerization at 65° C. for 5 hours while the air was replaced by nitrogen gas, so that an aqueous dispersion-type pressure-sensitive adhesive solution with a solid concentration of 62% was obtained. Subsequently, after the emulsion solution was cooled to room temperature, 20 parts of 10% ammonia water was added to the emulsion solution. Distilled water was further added to the emulsion solution so that its solid concentration was adjusted to 60%. The viscosity of the resulting liquid was 5,000 mPa·s as measured using a Brookfield type viscometer (manufactured by Toki Sangyo Co., Ltd.) at 23° C. and a rotor speed of 20 rpm.

In Example 11, the distance D1 was set at 2.1 mm, and the distance D2 was set at 15 μm, when the coating solution 70 was applied to the first surface of the backing sheet 1 from the discharge port 74 of the die coater 7. The backing sheet 1 was 38 μm in thickness. The coating solution 70 was applied to form a 38-μm-thick wet coating. After dried at 120° C., the coating was 23 μm in thickness. In the application of the coating solution 70, the coating width was 1,250 mm, and the coating speed was 20 m/minute.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 5, which showed that the occurrence of streak defects was also effectively suppressed.

Example 12

In Example 12, an aqueous dispersion-type acryl-based pressure-sensitive adhesive was used as the coating solution 70. The aqueous dispersion-type acryl-based pressure-sensitive adhesive was prepared as follows. To a vessel were added 55,554 parts of butyl acrylate, 2,776 parts of acrylic acid, 1,665 parts of mono[poly(propylene oxide)methacrylate] phosphate ester (5.0 in average degree of polymerization of propylene oxide), and 5 parts of 3-methacryloyloxypropyltriethoxysilane (KBM-503 manufactured by Shin-Etsu Chemical Co., Ltd.) as starting materials, and mixed to form a monomer mixture. Subsequently, 1,300 parts of AQUALON HS-10 (manufactured by DAI-ICHI KOGYO SEIYAKU CO., LTD.) as a reactive surfactant and 38,700 parts of ion-exchanged water were added to 58,060 parts of the prepared monomer mixture. The resulting mixture was stirred at 7,000 rpm for 10 minutes using a homogenizer (manufactured by PRIMIX Corporation) to form a monomer emulsion. Subsequently, 20,000 parts of the monomer emulsion prepared as described above and 35,000 parts of ion-exchanged water were added to a reaction vessel equipped with a condenser tube, a nitrogen-introducing tube, a thermometer, a dropping funnel, and a stirring blade. Subsequently, after the air in the reaction vessel was sufficiently replaced by nitrogen gas, 10 parts of ammonium persulfate was added to the reaction vessel, and the mixture was subjected to polymerization at 60° C. for 1 hour. Subsequently, 80,000 parts of the remaining monomer emulsion was added dropwise to the reaction vessel over 3 hours, and then the mixture was subjected to polymerization for 3 hours. Subsequently, the mixture was further subjected to polymerization at 65° C. for 5 hours while the air was replaced by nitrogen gas, so that an aqueous dispersion-type pressure-sensitive adhesive solution with a solid concentration of 45% was obtained. Subsequently, after the emulsion solution was cooled to room temperature, 10% ammonia water was added to adjust the pH of the solution to 8. Based on 100 parts of the solids of the emulsion, 1.5 parts of a modified polyacrylic acid-based thickener (SN Thickener 640 manufactured by San Nopco Limited) was added to the emulsion. Ion-exchanged water was further added to the emulsion so that its solid concentration was adjusted to 20%. The viscosity of the resulting liquid was 500 mPa·s as measured using a Brookfield type viscometer (manufactured by Toki Sangyo Co., Ltd.) at 23° C. and a rotor speed of 20 rpm.

In Example 12, the distance D1 was set at 2.1 mm, and the distance D2 was set at 15 μm, when the coating solution 70 was applied to the first surface of the backing sheet 1 from the discharge port 74 of the die coater 7. The backing sheet 1 was 38 μm in thickness. The coating solution 70 was applied to form a 125-μm-thick wet coating. After dried at 120° C., the coating was 25 μm in thickness. In the application of the coating solution 70, the coating width was 1,250 mm, and the coating speed was 20 m/minute.

It was observed whether or not dented defects occurred on the prepared optical pressure-sensitive adhesive sheet. The result of the observation showed that no dented defects were formed and the occurrence of dented defects was effectively suppressed. It was also observed whether or not streaks were formed on the prepared optical pressure-sensitive adhesive sheet. The result of the observation was level 3, which showed that the occurrence of streak defects was also relatively suppressed.

Comparative Example 1

In Comparative Example 1, the distance D1 was 0 mm, and the distance D2 was 0 μm, namely, the setting was such that the starting line P1 and the boundary line P2 coincided with each other, when the coating solution 70 was applied to the first surface of the backing sheet 1 from the discharge port 74 of the die coater 7. The other conditions were the same as those in Example 1.

It was observed whether or not streaks were formed on the prepared optical pressure-sensitive adhesive sheet. The result of the observation was level 5, which showed that the occurrence of streak defects was suppressed. It was also observed whether or not dented defects occurred on the prepared optical pressure-sensitive adhesive sheet. In contrast, the result of the observation showed that 48 dented defects were formed per 1 m and thus dented defects were not prevented.

Comparative Example 2

In Comparative Example 2, the distance D1 was set at 55.0 mm, and the distance D2 was set at 10,450 μm, when the coating solution 70 was applied to the first surface of the backing sheet 1 from the discharge port 74 of the die coater 7. The other conditions were the same as those in Example 1.

It was observed whether or not dented defects occurred on the prepared optical pressure-sensitive adhesive sheet. The result of the observation showed that no dented defects were formed and the occurrence of dented defects was suppressed. It was also observed whether or not streaks were formed on the prepared optical pressure-sensitive adhesive sheet. In contrast, the result of the observation was level 1, which showed that streak defects were not prevented.

Comparative Example 3

In Comparative Example 3, the distance D1 was set at 1.1 mm, and the distance D2 was set at 4 μm, when the coating solution 70 was applied to the first surface of the backing sheet 1 from the discharge port 74 of the die coater 7. The other conditions were the same as those in Example 1.

It was observed whether or not streaks were formed on the prepared optical pressure-sensitive adhesive sheet. The result of the observation was level 5, which showed that the occurrence of streak defects was suppressed. It was also observed whether or not dented defects occurred on the prepared optical pressure-sensitive adhesive sheet. In contrast, the result of the observation showed that 20 dented defects were formed per 1 m and thus dented defects were not prevented.

Comparative Example 4

In Comparative Example 4, the distance D1 was set at 55.0 mm, and the distance D2 was set at 10,450 μm, when the coating solution 70 was applied to the first surface of the backing sheet 1 from the discharge port 74 of the die coater 7. The backing sheet 1 was 75 μm in thickness. The other conditions were the same as those in Example 1.

It was observed whether or not dented defects occurred on the prepared optical pressure-sensitive adhesive sheet. The result of the observation showed that no dented defects were formed and the occurrence of dented defects was suppressed. It was also observed whether or not streaks were formed on the prepared optical pressure-sensitive adhesive sheet. In contrast, the result of the observation was level 2, which showed that streak defects were not prevented.

Comparative Example 5

In Comparative Example 5, the distance D1 was set at 1.1 mm, and the distance D2 was set at 4 μm, when the coating solution 70 was applied to the first surface of the backing sheet 1 from the discharge port 74 of the die coater 7. The backing sheet 1 was 39 μm in thickness. The coating solution 70 was applied to form a 170-μm-thick wet coating. After dried at 120° C., the coating was 65 μmin thickness. The other conditions were the same as those in Example 1.

It was observed whether or not streaks were formed on the prepared optical pressure-sensitive adhesive sheet. The result of the observation was level 4, which showed that the occurrence of streak defects was suppressed. It was also observed whether or not dented defects occurred on the prepared optical pressure-sensitive adhesive sheet. In contrast, the result of the observation showed that 5 dented defects were formed per 1 m and thus dented defects were not effectively prevented.

Comparative Example 6

In Comparative Example 6, the distance D1 was set at 100.0 mm, and the distance D2 was set at 38,200 μm, when the coating solution 70 was applied to the first surface of the backing sheet 1 from the discharge port 74 of the die coater 7. The backing sheet 1 was 39 μm in thickness. The coating solution 70 was applied to form a 20-μm-thick wet coating. After dried at 120° C., the coating was 8 μm in thickness. The other conditions were the same as those in Example 1.

It was observed whether or not dented defects occurred on the prepared optical pressure-sensitive adhesive sheet. The result of the observation showed that no dented defects were formed and the occurrence of dented defects was suppressed. It was also observed whether or not streaks were formed on the prepared optical pressure-sensitive adhesive sheet. In contrast, the result of the observation was level 1, which showed that streak defects were not prevented.

The experimental results are shown in Table 1 below.

TABLE 1

| | Coating solution | Base (%) | Viscosity (mPa · s) | Wet coating thickness (μm) | Coating thickness after drying (μm) | Backing sheet thickness (μm) | Distance D1 (mm) | Distance D2 (μm) | Number (/m) of dented defects | Streak level |
|---|---|---|---|---|---|---|---|---|---|---|
| Example 1 | Aqueous dispersion-type acryl-based pressure-sensitive adhesive | 39 | 2000 | 59 | 23 | 38 | 2.1 | 15 | 0 | 5 |
| Example 2 | Aqueous dispersion-type acryl-based pressure-sensitive adhesive | 39 | 2000 | 59 | 23 | 38 | 3.5 | 40 | 0 | 5 |
| Example 3 | Aqueous dispersion-type acryl-based pressure-sensitive adhesive | 39 | 2000 | 59 | 23 | 38 | 5.0 | 83 | 0 | 5 |
| Example 4 | Aqueous dispersion-type acryl-based pressure-sensitive adhesive | 39 | 2000 | 59 | 23 | 38 | 24.0 | 1930 | 0 | 4 |
| Example 5 | Aqueous dispersion-type acryl-based pressure-sensitive adhesive | 39 | 2000 | 59 | 23 | 38 | 48.0 | 7890 | 0 | 3 |
| Example 6 | Aqueous dispersion-type acryl-based pressure-sensitive adhesive | 39 | 2000 | 59 | 23 | 38 | 1.5 | 8 | 3 | 5 |
| Example 7 | Aqueous dispersion-type acryl-based pressure-sensitive adhesive | 39 | 2000 | 59 | 23 | 75 | 48.0 | 7890 | 0 | 4 |
| Example 8 | Aqueous dispersion-type acryl-based pressure-sensitive adhesive | 39 | 2000 | 144 | 55 | 38 | 2.1 | 15 | 0 | 5 |
| Example 9 | Aqueous dispersion-type acryl-based pressure-sensitive adhesive | 39 | 2000 | 30 | 12 | 38 | 2.1 | 15 | 0 | 3 |
| Example 10 | Solvent type acryl-based pressure-sensitive adhesive | 30 | 11000 | 77 | 23 | 38 | 2.1 | 15 | 0 | 5 |
| Example 11 | Aqueous dispersion-type acryl-based pressure-sensitive adhesive | 60 | 5000 | 38 | 23 | 38 | 2.1 | 15 | 0 | 5 |
| Example 12 | Aqueous dispersion-type acryl-based pressure-sensitive adhesive | 20 | 500 | 125 | 25 | 38 | 2.1 | 15 | 0 | 3 |
| Comparative Example 1 | Aqueous dispersion-type acryl-based pressure-sensitive adhesive | 39 | 2000 | 59 | 23 | 38 | 0.0 | 0 | 48 | 5 |
| Comparative Example 2 | Aqueous dispersion-type acryl-based pressure-sensitive adhesive | 39 | 2000 | 59 | 23 | 38 | 55.0 | 10450 | 0 | 1 |
| Comparative Example 3 | Aqueous dispersion-type acryl-based pressure-sensitive adhesive | 39 | 2000 | 59 | 23 | 38 | 1.1 | 4 | 20 | 5 |
| Comparative Example 4 | Aqueous dispersion-type acryl-based pressure-sensitive adhesive | 39 | 2000 | 59 | 23 | 75 | 55.0 | 10450 | 0 | 2 |
| Comparative Example 5 | Aqueous dispersion-type acryl-based pressure-sensitive adhesive | 39 | 2000 | 170 | 65 | 39 | 1.1 | 4 | 5 | 4 |
| Comparative Example 6 | Aqueous dispersion-type acryl-based pressure-sensitive adhesive | 39 | 2000 | 20 | 8 | 39 | 100.0 | 38200 | 0 | 1 |

DESCRIPTION OF REFERENCE SIGNS

1 Backing sheet
2 Film member
3 Sheet material
4 Roll
5 Feed roller
6 Pretreatment apparatus
7 Die coater
8 Backup roller
9 Drying apparatus
10 Roll
11 Undercoating apparatus
12 Bonding roller
13 Roll
70 Coating solution
71 Lip
72 Manifold
73 Groove
74 Discharge port
100 Contaminant
P1 Starting line
P2 Boundary line
P3 Line on roller
P4 Boundary line

The invention claimed is:

1. A method for applying a coating solution to a first surface of a flexible backing sheet from a discharge port of a die coater, wherein the backing sheet is being fed, and the discharge port linearly extends along a transverse direction perpendicular to a direction of feed of the backing sheet, the method comprising:

bringing a second surface of the backing sheet into contact with an outer surface of a roller while feeding the backing sheet as the roller rotates, wherein the second surface is opposite to the first surface to which the coating solution is applied; and applying the coating solution to the first surface of the backing sheet from the discharge port of the die coater while feeding the backing sheet as the roller rotates, wherein the discharge port is located downstream relative to the roller and the die coater is static relative to the roller when applying the coating solution, and the die coater is positionally static relative to the roller when applying the coating solution, wherein when a virtual line is drawn to pass through the discharge port of the die coater and to extend perpendicular to the backing sheet, the distance between a starting line and a boundary line is 50 mm or less, wherein the starting line is defined as a line intersecting with the virtual line on the second surface of the backing sheet, and the boundary line is defined as a line at a boundary where the second surface of the backing sheet begins to separate, upstream of the starting line, from the outer surface of the roller as the roller rotates, and the distance between the starting line and a line on the roller is 5 um or more, wherein the line on the roller is defined as a line intersecting with the virtual line on the outer surface of the roller.

2. The method according to claim 1, wherein the coating solution is applied to the backing sheet to form a wet coating with a thickness of 10 μm to 150 μm.

3. The method according to claim 1, wherein the coating solution applied to the backing sheet has a weight percent solid concentration of 5 to 70%.

* * * * *